US008499925B2

(12) United States Patent
Arimoto et al.

(10) Patent No.: US 8,499,925 B2
(45) Date of Patent: Aug. 6, 2013

(54) CONVEYING ROLLER AND METHOD OF MAKING THE SAME

(75) Inventors: Shigeru Arimoto, Osaka (JP); Seiichi Ishikawa, Kagawa (JP)

(73) Assignee: Uni-Charm Corporation, Ehime (JP)

( * ) Notice: Subject to any disclaimer, the term of this patent is extended or adjusted under 35 U.S.C. 154(b) by 157 days.

(21) Appl. No.: 13/119,440

(22) PCT Filed: Sep. 17, 2009

(86) PCT No.: PCT/JP2009/066263
§ 371 (c)(1),
(2), (4) Date: Mar. 17, 2011

(87) PCT Pub. No.: WO2010/032787
PCT Pub. Date: Mar. 25, 2010

(65) Prior Publication Data

US 2011/0168521 A1 Jul. 14, 2011

(30) Foreign Application Priority Data

Sep. 19, 2008 (JP) ..... 2008-240221

(51) Int. Cl.
*B65G 23/04* (2006.01)

(52) U.S. Cl.
USPC ..... 198/835; 193/37

(58) Field of Classification Search
USPC ..... 193/35 R, 37; 198/832, 835
See application file for complete search history.

(56) References Cited

U.S. PATENT DOCUMENTS

| | | | | | |
|---|---|---|---|---|---|
| 2,162,279 | A * | 6/1939 | Herchenrider | ..... | 451/301 |
| 2,628,709 | A * | 2/1953 | Steinmetz | ..... | 198/494 |
| 3,050,178 | A * | 8/1962 | Stone | ..... | 198/834 |
| 4,718,544 | A * | 1/1988 | Herren | ..... | 198/843 |
| 5,794,758 | A * | 8/1998 | Bakker et al. | ..... | 198/785 |
| 6,143,404 | A * | 11/2000 | Bruhmann et al. | ..... | 198/835 |
| 6,168,544 | B1 * | 1/2001 | Barnes et al. | ..... | 198/835 |
| 8,196,738 | B1 * | 6/2012 | Wolf et al. | ..... | 198/835 |

FOREIGN PATENT DOCUMENTS

| | | |
|---|---|---|
| JP | 04072261 | 3/1992 |
| JP | 2001192138 | 7/2001 |
| JP | 2001206579 | 7/2001 |
| JP | 3108112 | 4/2005 |

OTHER PUBLICATIONS

International Search Report for PCT/JP2009/066263 mailed Dec. 1, 2009.

* cited by examiner

*Primary Examiner* — James R Bidwell
(74) *Attorney, Agent, or Firm* — Lowe Hauptman Ham & Berner, LLP

(57) ABSTRACT

A conveying roller facilitates conveyance of a sticky material in the form of sheet or web to be conveyed. An outer peripheral layer of the convey roller is formed on its rolling surface with a plurality of pits at a predetermined occupancy ratio defined by an occupancy ratio of a total area occupied by all of the pits to an area of the rolling surface of the outer peripheral layer. The outer peripheral layer is formed on the rolling surface thereof with a plurality of pits at the occupancy ratio set depending on a degree of stickiness expressed by the sheet material to achieve peel properties of the outer peripheral layer which is compatible with the stickiness of the sheet material and thereby to prevent the sticky sheet material from twining around the conveying roller.

9 Claims, 8 Drawing Sheets

CONVEYING ROLLER AND METHOD OF MAKING THE SAME

RELATED APPLICATIONS

The present application is a national phase of PCT/JP2009/066263, filed on Sep. 17, 2009 and is based on, and claims priority from, Japanese Application Number 2008-240221, filed Sep. 19, 2008.

TECHNICAL FIELD

The present invention relates to conveying rollers used to convey a material in the form of sheet or web to be conveyed and methods of making such conveying rollers.

RELATED ART

Conventionally, conveying rollers to convey a material in the form of sheet or web such as thermosensitive paper are known and widely used. As a conveying roller of this type, the conveying roller comprising a body roller and synthetic rubber formed, for example, of room-temperature curing silicone rubber (referred to hereinafter as RTV silicone rubber) or millable type silicone rubber covering the body roller is known.

The conveying roller of this type is sometimes used to coat the material in the form of sheet or web to be conveyed with sticky materials (adhesives) or to convey the material in the form of sheet or web having stickiness.

However, there is a problem that the sticky material in the form of sheet or web to be conveyed is apt to twine around the conveying roller and to make conveyance of such material to be conveyed difficult.

In view of the above problem, PATENT DOCUMENT 1 proposes a conveying roller having a plurality of protuberances on a peripheral surface thereof.

PRIOR ART DOCUMENT

Patent Document

PATENT DOCUMENT 1: JP 2001-206579 A

SUMMARY OF THE INVENTION

Problem to be Solved by the Invention

In the case of the conveying roller disclosed by PATENT DOCUMENT 1, the load is concentrated to the respective protuberances in the course of conveying. Conveyance of the material in the form of sheet or web by the conveying roller formed with the protuberances inevitably results in a destabilized conveyance.

The conveying roller formed with the protuberances as the conveying roller disclosed by PATENT DOCUMENT 1 is the case has sometimes caused mis-conveyance due to its own instability. For example, the material in the form of sheet or web to be conveyed has often been deformed under the load concentrated on the respective protuberances. Eventually, the conveying rollers of prior art including the conveying roller disclosed by PATENT DOCUMENT 1 have left the problem that the sticky material in the form of sheet or web to be conveyed can not reliably conveyed.

It is an object of the present invention to provide a conveying roller improved so as to stabilize and thereby to facilitate conveyance of the sticky material in the form of sheet or web to be conveyed and a method of making such conveying roller.

Measure to Solve the Problem

According to the present invention, there is provided a conveying roller comprising arrangements as described below.

(1) A conveying roller comprising a body roller and an outer peripheral layer of the roller so that the outer peripheral layer rotates to convey material in the form of sheet or web to be conveyed, characterized in that the outer peripheral layer is formed on an rolling surface thereof with a plurality of pits at a predetermined occupancy ratio defined by an occupancy ratio of a total area occupied by all of the pits to an area of the rolling surface of the outer peripheral layer.

In this arrangement, the plural pits may be in the form of through-holes extending through the outer peripheral layer or in the form of the pits extending not through the outer peripheral layer but defining depressions in the outer peripheral layer. The aforementioned occupancy ratio depends on the diameter size, the shape and the number of the pits. The occupancy ratio may be appropriately varied to control the peel properties of the outer peripheral layer. A plurality of the pits may be formed on the outer peripheral layer at a predetermined occupancy ratio depending on a degree of the stickiness expressed by the object to be conveyed to obtain the peel properties of the outer peripheral layer which is compatible with the stickiness of the material to be conveyed.

In this way, it is possible to prevent the sticky material in the form of sheet or web to be conveyed from twining around the conveying roller. The conveying roller according to this arrangement has no protuberances formed thereon as the conveying roller disclosed in PATENT DOCUMENT 1 is the case and therefore the material in the form of sheet or web to be conveyed should not be deformed. In this way, the conveying roller according to this arrangement stabilizes and facilitates conveyance of the sticky material in the form of sheet or web to be conveyed.

Plural pits are formed on the rolling surface of the outer peripheral layer and mass of the conveying roller is correspondingly reduced. In consequence, a drive force required to rotate the conveying roller and cost of power are also correspondingly reduced.

(2) Of the plural pits, the pits arranged in each row so as to come in contact with the material in the form of sheet or web at the same instant during conveyance are uniform in shape as well as in size.

According to this arrangement, the outer peripheral layer is uniformly put in contact with the material in the form of sheet or web to be conveyed and therefore the load exerted on the material in the form of sheet or web to be conveyed is equalized. As a result, conveyance of the material in the form of sheet or web to be conveyed is further stabilized and further facilitated.

(3) The plural pits are shaped in a plover- or square-pattern.

According to this arrangement also, the outer peripheral layer is uniformly put in contact with the material in the form of sheet or web to be conveyed and therefore the load exerted on the material in the form of sheet or web to be conveyed is equalized. As a result, conveyance of the material in the form of sheet or web to be conveyed is further stabilized and further facilitated.

(4) The occupancy ratio is in a range of 20% to 80%.

(5) The plural pits of the outer peripheral layer are respectively filled with a release agent assisting the material in the form of sheet or web to be peeled off from the conveying roller.

The material in the form of sheet or web to be conveyed having a relatively high stickiness is apt to twine around the conveying roller and to make conveyance further difficult. To overcome this problem, according to this arrangement, even if a variation of the surface shape of the outer peripheral layer is limited, for example, even if the occupancy ratio of the pits is limited by a ceiling from the viewpoint of keeping the uniform load exerted on the material in the form of sheet or web to be conveyed, the countermeasure other than increasing of the occupancy ratio of the pits is available. Specifically, depending on a degree of stickiness expressed by the material in the form of sheet or web to be conveyed, the outer peripheral layer 11 may be provided with appropriate peel properties.

In this way, even when it is desired to convey the material in the form of sheet or web to be conveyed having high stickiness, it is possible to prevent such sticky material in the form of sheet or web to be conveyed from twining around the conveying roller and thereby conveyance of such sticky material in the form of sheet or web to be conveyed is further facilitated.

(6) The outer peripheral layer is made of rubber.

(7) Each of the plural pits is shaped to be tapered, i.e., to have a diameter gradually decreased from the rolling surface to the inner surface of the outer peripheral layer.

According to the present invention, there is provided a method of making the conveying roller having the steps as described below:

(8) molding rubbers to form a outmost peripheral layer in a planar state;

drilling the rolling surface of the outer peripheral layer obtained in the step of molding to form a plurality of pits at a predetermined occupancy ratio defined by the occupancy ratio of a total area occupied by all of the pits to an area of the rolling surface of the outer peripheral layer; and covering an outer peripheral surface of a body roller with the outer peripheral layer by joining circumferentially opposite ends of the outer peripheral layer having been formed with a plurality of pits in the step of drilling to each other.

According to this arrangement, the steps of molding, drilling and covering are steps carried out to obtain the finished conveying roller using rubbers as basic material.

This arrangement provides the same effect as the effect provided by the arrangement (1).

(9) The method further includes, prior to the step of covering, a step of filling the plural pits of the outer peripheral layer with release substances assisting the material in the form of sheet or web to be peeled off the conveying roller.

The step of filling is carried out after the step of drilling. After the step of filling, the component members are treated in the step of covering and the finished conveying roller is obtained.

This step provides the same effect as the arrangement described in paragraph (5) provides.

Effect of the Invention

The present invention facilitates the sticky material in the form of sheet or web to be conveyed.

IDENTIFICATION OF REFERENCE NUMERALS USED IN THE DRAWINGS

Figure 1:
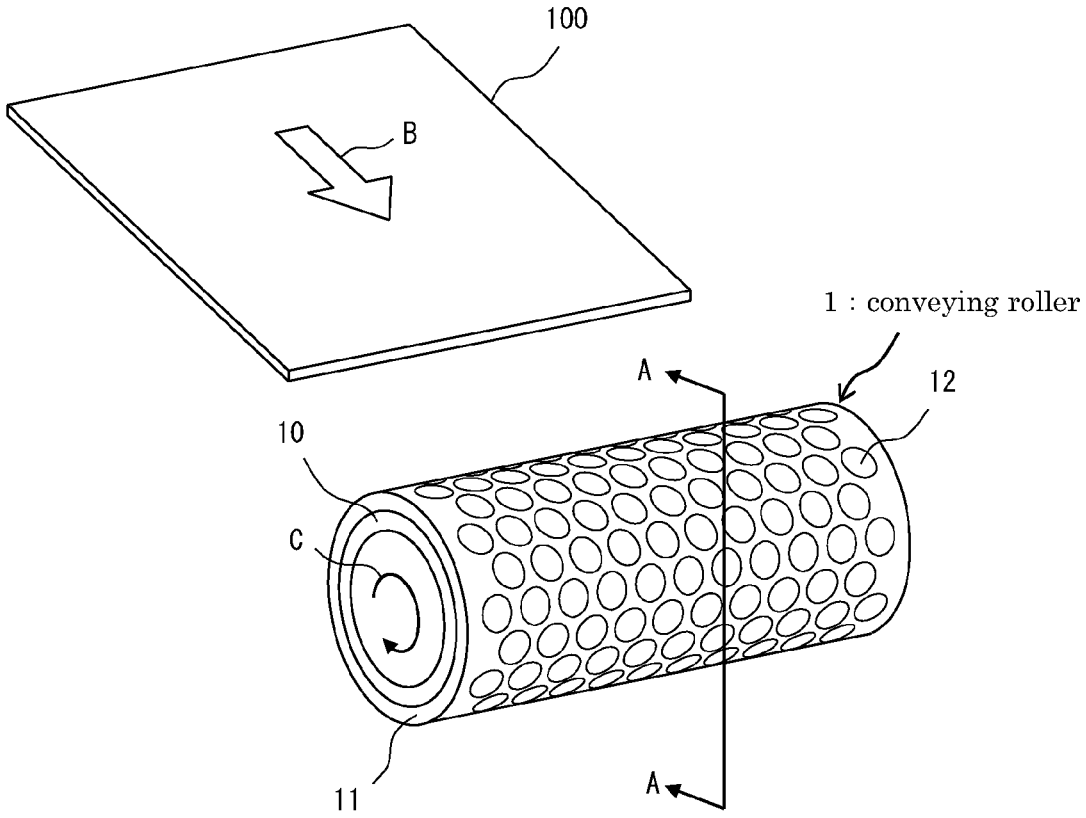
FIG. 1 is a perspective view of a conveying roller according to a first embodiment of the present invention.

1 conveying roller
2 conveying roller
10 body roller
11 outer peripheral layer
12 pits
13 adhesive agent
14 wrap
15 grindstone
20 pressing machine
22 release agent
23 release sheet
100 sticky material in the form of sheet or web
101 sticky material in the form of sheet or web

DETAILED DESCRIPTION OF THE PREFERRED EMBODIMENTS

Details of a conveying roller according to the first embodiment of the present invention will be more fully understood from the following description with reference to the accompanying drawings.

Figure 2:
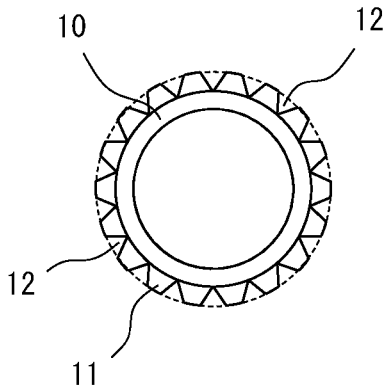
FIG. 2 is a sectional view taken along line A-A in FIG. 1.

FIG. 1 is a perspective view of a conveying roller according to a first embodiment of the present invention and FIG. 2 is a sectional view taken along line A-A in FIG. 1. The conveying roller 1 includes a body roller 10 made cylinderly of aluminum and an outer peripheral layer 11 integrally covering cylinderly an outer peripheral surface of the body roller 10. With the conveying roller 1 having such a structure, the outer peripheral layer 11 rotates integrally with the body roller 10 a material in the form of sheet or web (hereinafter referred to as "sheet material") in a direction C to convey sheet material 100 in a direction B. The outer peripheral layer 11 is formed of RTV (Room Temperature Vulcanization) silicone rubber or millable type silicone rubber.

It should be appreciated that materials for the body roller 10 are not limited to aluminum and the other metallic materials such as steels or stainless steels or resinous materials such as carbon fiber-based composite materials may be used to form the body roller 10. The outer peripheral layer 11 also may be formed of the other type of rubber materials or resinous materials.

The conveying roller disclosed herein is the conveying roller used in a step of coating the sheet material 100 with sticky substances and conveying the sheet material 100 provided with stickiness in this manner.

The sticky sheet material 100 is apt to twine around the conveying roller 1, making it difficult to convey the sheet material 1 smoothly.

As one example of countermeasures to solve this problem, the outer peripheral layer 11 is formed with a plurality of pits 12 each having a diameter gradually decreased from the rolling surface to the inner surface of the outer peripheral layer 11, i.e., in a tapered fashion, at a predetermined occupancy ratio (See FIGS. 1 and 2). As used herein, the term "occupancy ratio of the pits" means a ratio of total area occupied by all of the pits 12 to the area of the rolling surface of the outer peripheral layer 11. The occupancy ratio of the pits 12 is preferably in a range of 20% to 80% depending on the diameter, the shape and the number of the respective pits 12. According to the present embodiment, the peel properties of outer peripheral layer 11 are controlled by appropriately varying the occupancy ratio of the pits. Specifically, the rolling surface of the outer peripheral layer 11 may be formed with a plurality of the pits 12 at the occupancy ratio predetermined depending on a degree of stickiness of the sheet material 100 to assure the outer peripheral layer 11 to express appropriate peel properties. The present embodiment is based on the assumption that the shape of the individual pits 12 may be selected from various shapes including a circular shape, the pits may be arranged at a pitch in a range of 5 to 10 mm and the diameter of the outer peripheral layer 11 may be selected from those of the widely used in the conveying rollers of well known to those skilled in the art.

In this way, by assuring the outer peripheral layer 11 to have the peel properties which are compatible with the degree of stickiness of the sheet material 100, it is possible to prevent the sticky sheet material 100 from twining around the conveying roller 1. The conveying roller 1 is formed with none of the protuberances as those formed on the conveying roller disclosed in PATENT DOCUMENT 1 and therefore the sheet material 100 should not be deformed in the course of being conveyed. In this way, conveyance of the sticky sheet material 100 is stabilized and facilitated.

In addition, the rolling surface of the outer peripheral layer 11 is formed with a plurality of the pits 12 and a mass of the conveying roller 1 is correspondingly reduced. This means that the conveying roller 1 can be rotated by a correspondingly lower drive force. In consequence, a cost of power can be correspondingly reduced.

The pits 12 are uniformly shaped, for example, in a plover- or square-pattern and therefore the outer peripheral layer 11 evenly comes in contact with the sheet material 100 during conveyance. In this way, conveyance of the sticky sheet material 100 is further stabilized and further facilitated.

Even silicone rubbers usually given priority to its properties such durability and abrasion resistance rather than its peel properties can obtain a desired degree of peel properties by increasing the occupancy ratio of the pits to enlarge the non-contact area. Therefore, the conveying roller having, in addition to durability and abrasion resistance, sufficient peel properties can be obtained by use of silicone rubbers. Even if age of service and/or the number of conveying cycles increases, the stability of conveying the sticky sheet material 100 can be maintained.

A plurality of pits 12 formed on the rolling surface of the outer peripheral layer 11 provides this rolling surface with the desired peel properties, allowing the rubber materials of low cost can be used.

While the aforementioned silicone rubbers are adopted in the present embodiment, it will be possible to use the other type of synthetic rubbers so far as such synthetic rubber is of the type given superiority to durability and abrasion resistance rather than peel properties.

Although it may be contemplate to form the rolling surface of the outer peripheral layer 11 is formed with grooves, in this case, a load will be concentrated on the segments defined between each of the adjacent grooves and the load will become uneven on the rolling surface of the roller. In contrast, if each row of the pits 12 arranged in the direction orthogonal to the conveyance direction B adapted to come in contact with the sheet material 100 simultaneously in the course of conveyance have a uniform diameter, as in the case illustrated in FIG. 1, the load will be evenly exerted on the sheet material 100. It will be obviously understood, a plurality of the pits 12 as seen in FIG. 1 formed on the rolling surface of the outer peripheral layer 11 are more effective to stabilize conveyance of the sheet material 100 than the grooves formed on the rolling surface of the outer peripheral layer 11. In consequence, the sticky sheet material 100 can be more easily conveyed.

Now respective steps of forming the finished conveying roller from various kinds of materials will be described in the order of these steps. First, the step of molding RTV silicone rubbers or millable type silicone rubbers will be described.

A step of molding is the step in which the outer peripheral layer 11 in its planar state is molded from silicone rubbers. In this step of molding, raw materials of silicone rubbers are poured into molds set in a forming machine to make the outer peripheral layer 11 still in a planar state. Then a step of drilling the pits on the planar outmost peripheral layer 11 will be described.

Figure 3:
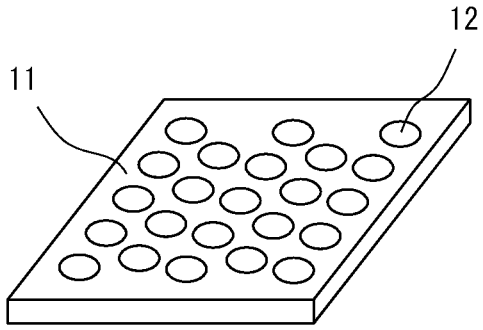
FIG. 3 is a diagram illustrating part of a peripheral layer having been formed in a step of drilling with a plurality of pits in a planar state.

FIG. 3 is a perspective view showing the still planar outer layer of the roller having been formed in a step of drilling with a plurality of pits. The step of drilling is the step in which the rolling surface of the outer layer 11 is formed with a plurality of pits 12 at a predetermined occupancy ratio. As used herein, the term "occupancy ratio of the pits" means a ratio of total area occupied by all of the pits 12 to the area of the rolling surface of the outer peripheral layer 11. The method of forming the pits includes Thomson drilling techniques, drilling, NC drilling techniques. While the outer layer 11 still in a planar state is subjected to the drilling according to the present embodiment, the outer layer 11 after covering the body roller 10 may be subjected to drilling work. Now a step of covering the body roller with the outer peripheral layer 11 will be described.

Figure 4:
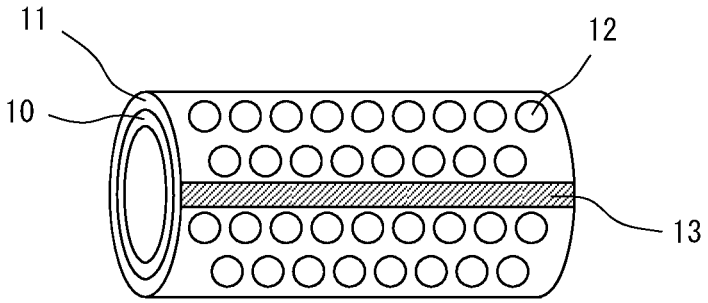
FIG. 4 is a schematic diagram illustrating a step of covering body roller with an outer peripheral layer.

FIG. 4 is a schematic diagram illustrating this step of covering the body roller with the outer peripheral layer 11. In the step of covering the body roller with the outer peripheral layer 11, the outer peripheral layer 11 in a planar state and having been formed with a plurality of the pits 12 in the step of drilling is would around the body roller 10 and circumferentially opposite ends are joined to each other. The outer peripheral layer 11 and the outer peripheral surface of the body roller 10 are bonded to each other with room-temperature curing type rubbers or silicone-based adhesives. The circumferentially opposite ends of the outer peripheral layer 11 are bonded to each other with room-temperature curing type rubbers or thermosetting type rubbers. Then, a step of vulcanizing the outer peripheral layer 11 will be described.

Figure 5:
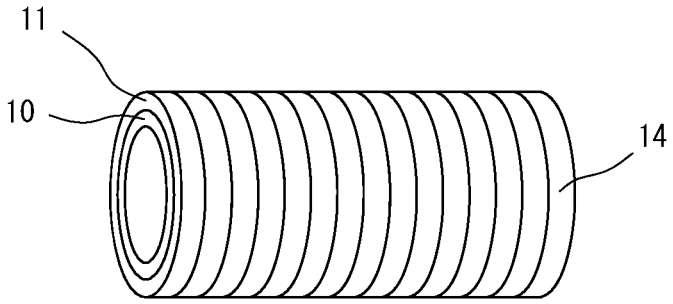
FIG. 5 is a schematic diagram illustrating a step of vulcanizing the outer peripheral layer.

FIG. 5 is a schematic diagram illustrating this step of vulcanizing the outer peripheral layer 11. When the aforementioned thermosetting type rubbers are used to bond the circumferentially opposite ends of the outer peripheral layer 11, in the step of vulcanization, the rolling surface of the outer layer 11 after the step of covering is wrapped with wrap 14 to stabilize the rolling surface of the outer peripheral layer 11 and then thermally cured in a steam pan. As the wrap 14, for example, polyester films or cloths may be used. In this step of vulcanization, the circumferentially opposite ends of the outer peripheral layer 11 are bonded to each other. Now a step of grinding the outer peripheral layer 11 will be described.

Figure 6:
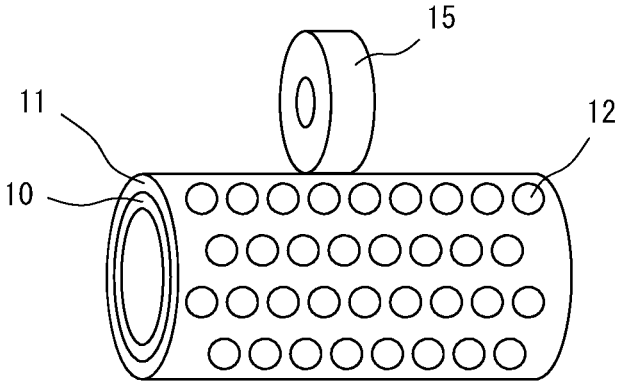
FIG. 6 is a schematic diagram illustrating a step of grinding a rolling surface of the outer peripheral layer.

FIG. 6 is a schematic diagram illustrating this step of grinding the rolling surface of the outer peripheral layer 11. In this step of grinding, the rolling surface of the outer peripheral layer 11 is ground by a grindstone 15 at a predetermined circumferential velocity (e.g., 2000 rpm). In this step, an amount of grinding may be adjusted to assure the diameter of the outer peripheral layer 11 within a predetermined tolerance zone and to form a uniform surface. Thereby the outer peripheral layer 11 is finished to provide the final product (conveying roller) as shown in FIG. 1.

Now the conveying roller according to the second embodiment of the present invention will be described.

Figure 7:
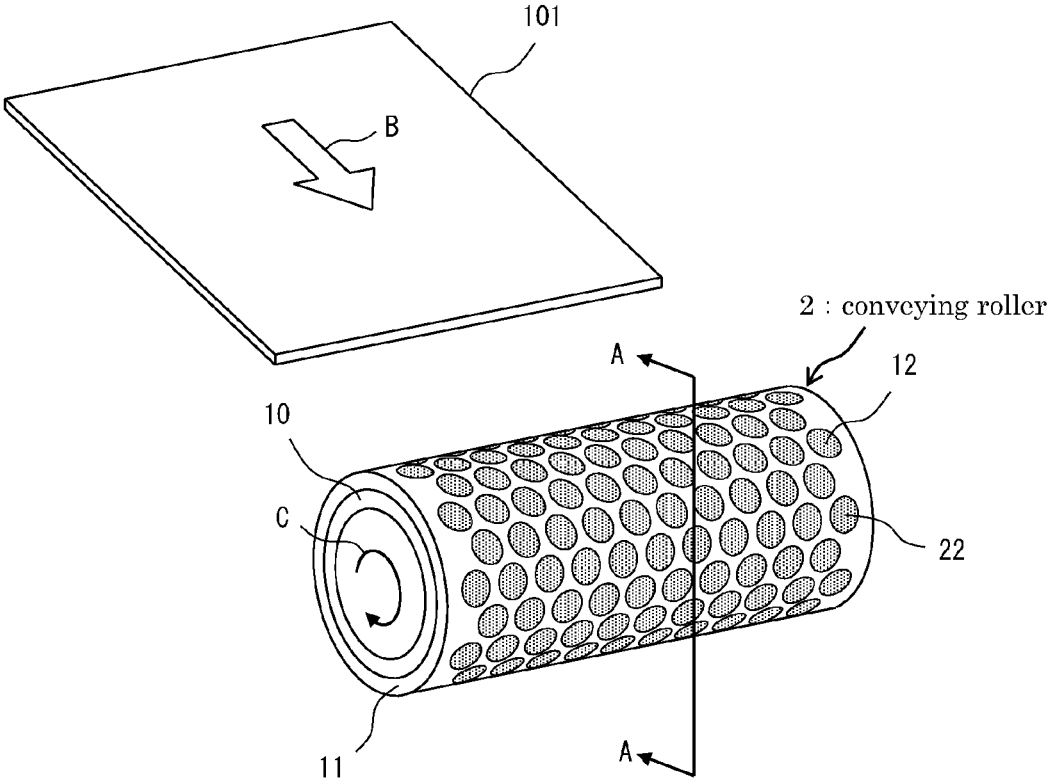
FIG. 7 is a perspective view of a conveying roller according to a second embodiment of the present invention.

FIG. 7 is a perspective view of the conveying roller according to a second embodiment of the present invention. A sheet material 101 has a higher stickiness than that of the sheet material 100. Due to the high stickiness of the sheet material 101, the sheet material 101 is apt to twine around the conveying roller and a progress of conveyance might be further unstable.

The conveying roller according to the present embodiment overcomes such problem by filling a plurality of the pits 12 of the outer peripheral layer 11 with release substances 22. The release substances are materials containing the ingredient functioning to peel the sheet material 101 off from the conveying roller 1. In this way, even when transfiguration of the surface shape due to filling of the release substances is limited, for example, even if the occupancy ratio of the pits is limited by a ceiling from the viewpoint of keeping the uniform load exerted on the sheet material 101, the countermeasure other than increasing of the occupancy ratio of the pits is available.

Specifically, depending on a degree of stickiness expressed by the sheet material 101, the outer peripheral layer 11 may be provided with appropriate peel properties.

In consequence, even when it is desired to convey the sheet material 101 having a relatively high stickiness, it is possible to prevent the sticky sheet material 101 from twining around the conveying roller 2. Furthermore, the conveying roller 2 is adapted to equalize a load exerted on the sheet material 101 so that the sticky sheet material 101 can be stably conveyed. As a result, the sticky sheet 101 material is capable of being easily conveyed.

Now a step of filling a plurality of the pits 12 with filler will be described.

Figure 8:
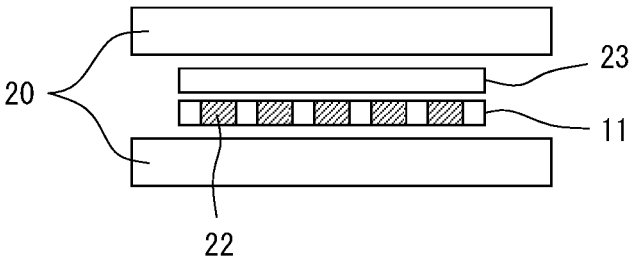
FIG. 8 is a schematic diagram illustrating a step of filling a plurality of pits having been formed in the step of drilling with release agent.

FIG. 8 is a schematic diagram illustrating this step of filling the outer peripheral layer 11 with the release substances. This step of filling is the step in which a plurality of the pits 12 formed in the step of drilling are respectively filled with release substances 22 and carried out before the step of covering. Filling of release substances is carried out by setting the outer peripheral layer 11 in a press machine 20 at a high temperature and then stacking the release sheet 23 made of release substances 22 on the outer peripheral layer 11. Then the release substances 22 are pressed into the respective pits by the press machine 20 at a high temperature and integrating with the outer peripheral layer 11 by room-temperature curing or thermosetting. It is noted here that, if the release substances 22 have fluidity at ambient temperature, it is possible to pour the release substances 22 directly into the respective pits 12.

After this step of filling, the outer peripheral layer 11 may be further worked in the step of covering, the step of vulcanization and the step of grinding to obtain the final product (conveying roller) as shown in FIG. 7.

The invention claimed is:

1. A conveying roller, comprising:

a body roller; and an outer peripheral layer including a rolling surface and a plurality of pits on the rolling surface, said outer peripheral layer rotatable to convey a material in the form of sheet or web to be conveyed, wherein said outer peripheral layer is integrally formed with the rolling surface, and the plurality of pits the pits are arranged at a predetermined occupancy ratio defined by a ratio of a total area occupied by all of said pits to an entire area of said rolling surface of said outer peripheral layer, and the pits are filled with a release agent for assisting said material in the form of sheet or web to be peeled off the conveying roller.

2. The conveying roller defined by claim 1, wherein said pits arranged in each row and adapted to come in contact with said material in the form of sheet or web at the same instant during conveyance are uniform in shape as well as in size.

3. The conveying roller defined by claim 1, wherein said pits are shaped in a plover- or square-pattern.

4. The conveying roller defined by claim 1, wherein said occupancy ratio is in a range of 20% to 80%.

5. The conveying roller defined by claim 1, wherein said outer peripheral layer is made of rubber.

6. The conveying roller defined by claim 1, wherein said outer peripheral layer further comprises an inner surface opposite to the rolling surface, and each of said pits is tapered and has a diameter gradually decreased from the rolling surface to the inner surface of said outer peripheral layer.

7. The conveying roller defined by claim 1, wherein said outer peripheral layer is configured to convey a sticky material in the form of sheet or web to be conveyed.

8. The conveying roller defined by claim 1, wherein the pits are provided in rows, and each of the rows extends parallel to an axial direction of the body roller.

9. The conveying roller defined by claim 1, wherein the pits are filled up with the release agent for assisting said material in the form of sheet or web to be peeled off the conveying roller.

* * * * *